US007078640B2

(12) United States Patent
Miyake et al.

(10) Patent No.: US 7,078,640 B2
(45) Date of Patent: Jul. 18, 2006

(54) OPENING SWITCH FOR AN OPENING AND CLOSING BODY

(75) Inventors: Yoshinori Miyake, Haga-gun (JP); Tomofumi Ichinose, Shioya-gun (JP); Kenichi Munenaga, Utsunomiya (JP); Kazuhiko Yamada, Shioya-gun (JP); Katsuyuki Ishiguro, Nirasaki (JP)

(73) Assignees: Honda Motor Co., Ltd., Tokyo (JP); Mitsui Mining and Smelting Co., Ltd., Tokyo (JP)

( * ) Notice: Subject to any disclaimer, the term of this patent is extended or adjusted under 35 U.S.C. 154(b) by 0 days.

(21) Appl. No.: 11/205,654

(22) Filed: Aug. 17, 2005

(65) Prior Publication Data

US 2006/0037850 A1 Feb. 23, 2006

(30) Foreign Application Priority Data

Aug. 23, 2004 (JP) ..... 2004-242938

(51) Int. Cl.
*H01H 13/14* (2006.01)
*H01H 3/12* (2006.01)

(52) U.S. Cl. ..... 200/341; 200/61.62; 200/522; 200/293.1; 292/121; 292/95

(58) Field of Classification Search ..... 200/341, 200/61.62, 61.75, 521, 522, 537, 553, 292, 200/293.1; 292/121–122, 95, 109
See application file for complete search history.

(56) References Cited

U.S. PATENT DOCUMENTS

| | | | | |
|---|---|---|---|---|
| 1,877,836 | A * | 9/1932 | Flynn | 292/169.11 |
| 4,160,887 | A * | 7/1979 | van Buren, Jr. | 200/61.62 |
| 5,242,210 | A * | 9/1993 | Fujisawa et al. | 296/219 |
| 5,690,206 | A * | 11/1997 | Carroll et al. | 192/136 |
| 6,416,106 | B1 * | 7/2002 | Ponziani | 296/56 |
| 6,681,912 | B1 * | 1/2004 | Suzuki et al. | 192/85 AA |
| 6,761,381 | B1 * | 7/2004 | Prada et al. | 292/121 |

FOREIGN PATENT DOCUMENTS

JP 2003-127668 5/2003

* cited by examiner

*Primary Examiner*—Richard K. Lee
(74) *Attorney, Agent, or Firm*—Rankin, Hill, Porter & Clark LLP

(57) ABSTRACT

An opening switch for an opening and closing body includes a switch base having a first substrate and a second substrate which are put together in a manner such that inner faces of the substrates face each other and outer faces of the substrates are outer faces of the switch base; a main switch body provided on the outer face of the first substrate; a lever portion which is provided on the inner face of the first substrate and passes the second substrate through a through hole; and a flange portion for preventing an over stroke of the lever portion. The flange portion protrudes from the outer face of the second substrate and is positioned away from the lever portion and on a side toward which the lever portion is inclined. A flexible cover member for covering a combined body of the lever portion and the flange portion is provided.

4 Claims, 3 Drawing Sheets

OPENING SWITCH FOR AN OPENING AND CLOSING BODY

BACKGROUND OF THE INVENTION

1. Field of the Invention

The present invention relates to an opening switch for an opening and closing body such as a trunk lid of a vehicle.

Priority is claimed on Japanese Patent Application No. 2004-242938, filed Aug. 23, 2004, the content of which is incorporated herein by reference.

2. Description of Related Art

There are vehicles (e.g., motorcars) having an opening switch for an opening and closing body (e.g., a trunk lid) from the outside. The opening switch may be a release switch provided in an opening behind a hand-operated handle of a rear door, and the latch of an electric lock system may be released by operating the release switch (see Japanese Unexamined Patent Application, First Publication No. 2003-127668).

In the above conventional opening switch, the operating direction of the switch may coincide with the operating direction for opening the rear door, thereby allowing for smoothly performing a series of operations from pressing the switch to opening the rear door. However, the conventional structure requires a process of searching for the position of the opening switch (which is a push button type) in the opening where the switch is provided. In particular, when the opening switch is covered with a garnish or the like, it is difficult to find the position of such a push button switch.

In order to solve this problem, the size of the switch may be increased so as to make it easy to find the switch position. However, in this case, a larger area and space are occupied by the switch. In addition, pushing force cannot be easily concentrated on such a wide area; thus, the pushing operation may not be easily performed.

SUMMARY OF THE INVENTION

In light of the above circumstances, an object of the present invention is to provide an opening switch for an opening and closing body, where the switch can be miniaturized and is easily operated.

Therefore, the present invention provides an opening switch (e.g., an opening switch 10 in an embodiment explained later) for an opening and closing body, the opening switch comprising:

a switch base (e.g., a switch base SB in the embodiment) having a first substrate (e.g., a base body 31 in the embodiment) and a second substrate (e.g., a base portion 41 in the embodiment) which are put together in a manner such that inner faces of the first and second substrates face each other and outer faces of the first and second substrates are outer faces of the switch base;

a main switch body (e.g., a main switch body 32 in the embodiment) provided on the outer face of the first substrate;

a lever portion (e.g., a lever portion 33 in the embodiment) which is provided on the inner face of the first substrate and passes the second substrate through a through hole (e.g., a through hole 43 in the embodiment) formed in the second substrate;

a flange portion (e.g., a flange portion 42 in the embodiment) for preventing an over stroke of the lever portion, wherein the flange portion protrudes from the outer face of the second substrate and is positioned away from the lever portion and on a side toward which the lever portion is inclined in an operation for the opening and closing body; and a flexible cover member (e.g., a boot 50 in the embodiment) for covering a combined body consisting of the lever portion and the flange portion.

According to the above structure, the first substrate and the second substrate are put together in a manner such that the inner faces of both substrates face each other, thereby producing the switch base. Therefore, the area of the switch base can be reduced as much as possible, thereby miniaturizing the total size of the opening switch.

In a typical example, the first substrate has a threaded hole (e.g., a threaded hole 35 in the embodiment) for fastening the opening switch to the opening and closing body; and the second substrate is fastened to the first substrate by cramping.

Accordingly, the main portion of the opening switch can be implemented by only fastening the second substrate to a known lever switch (which includes the main switch body and the lever portion which are provided on the first substrate) by cramping. Therefore, the opening switch can be easily manufactured through a minimized number of assembling processes with a minimum number of parts.

In another typical example, the flange portion is formed by cutting a portion of the second substrate while leaving a side of the portion, and righting this portion. Accordingly, the through hole for the lever portion provided on the first substrate and the flange portion can be simultaneously formed. Therefore, the second substrate can have a simple and light structure, thereby reducing the total weight of the opening switch.

DETAILED DESCRIPTION OF THE INVENTION

Hereinafter, embodiments according to the present invention will be described with reference to the Figures.

Figure 1:
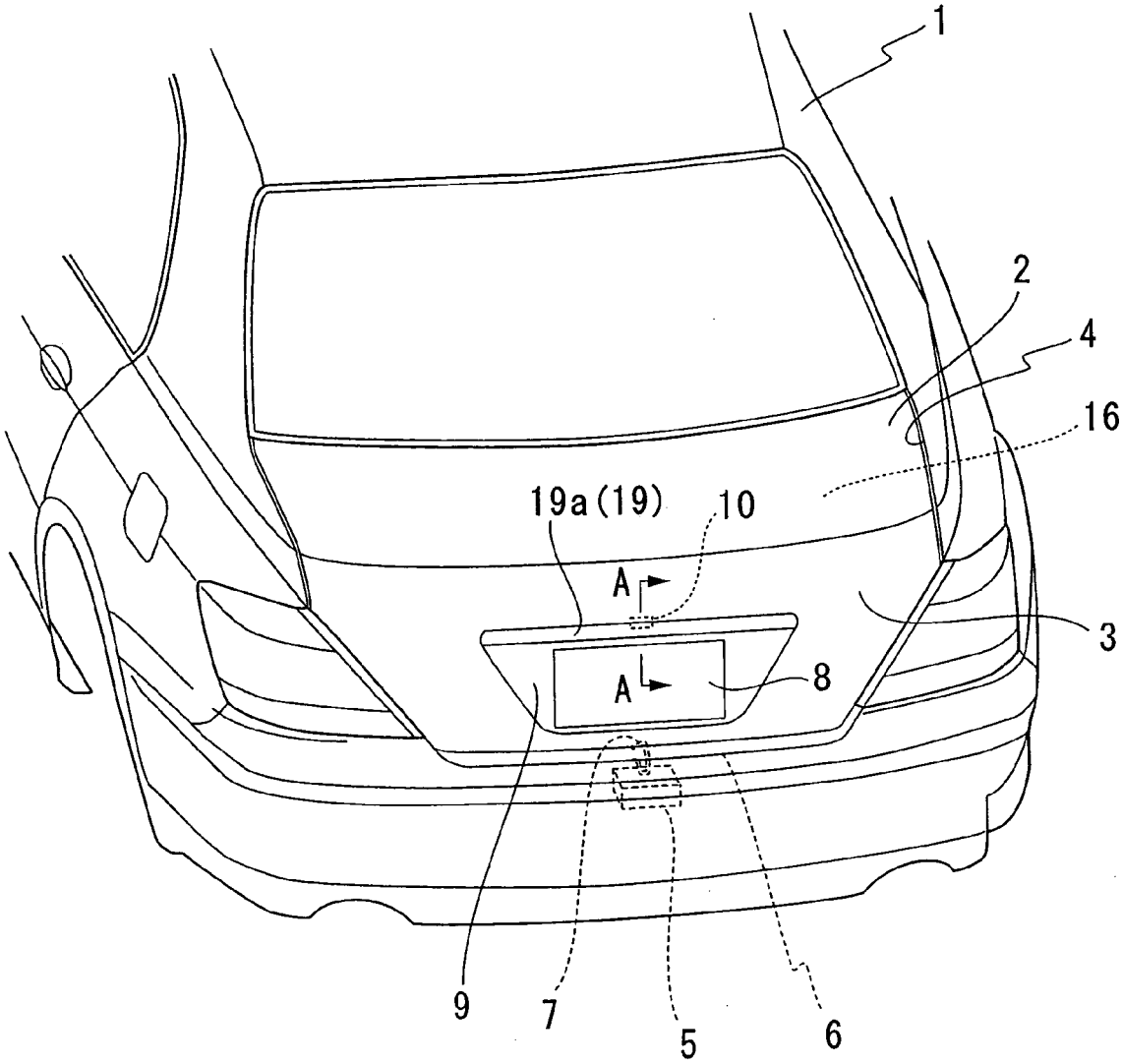
FIG. 1 is a partial perspective view showing a rear portion of a vehicle having a truck lid to which an opening switch as an embodiment of the present invention is attached.

FIG. 1 is a perspective view showing a vehicle having a truck lid to which an opening switch as an embodiment of the present invention is attached. As shown in FIG. 1, a trunk lid 2 is provided at a rear portion of a vehicle body 1 in a manner such that the trunk lid 2 can be opened and closed manually or automatically by using a motor. The trunk lid 2 has a rear wall 3 which extends downward so as to cover a wide area of a trunk opening 4 in the rear portion. A locking device 5 is provided at the lower edge of the trunk opening 4, and a striker for the locking device 5 is attached to the lower face 6 of the rear wall 3 of the trunk lid 2.

In the rear wall 3 of the trunk lid 2, a concave attachment portion 9 having an inverted trapezoid shape is provided, where a license plate 8 is mounted. An opening switch 10 for opening the trunk lid 2 is provided on the upper side of the attachment portion 9. The latched state between the locking device 5 and the striker 7 can be released by operating the opening switch 10.

Figure 2:
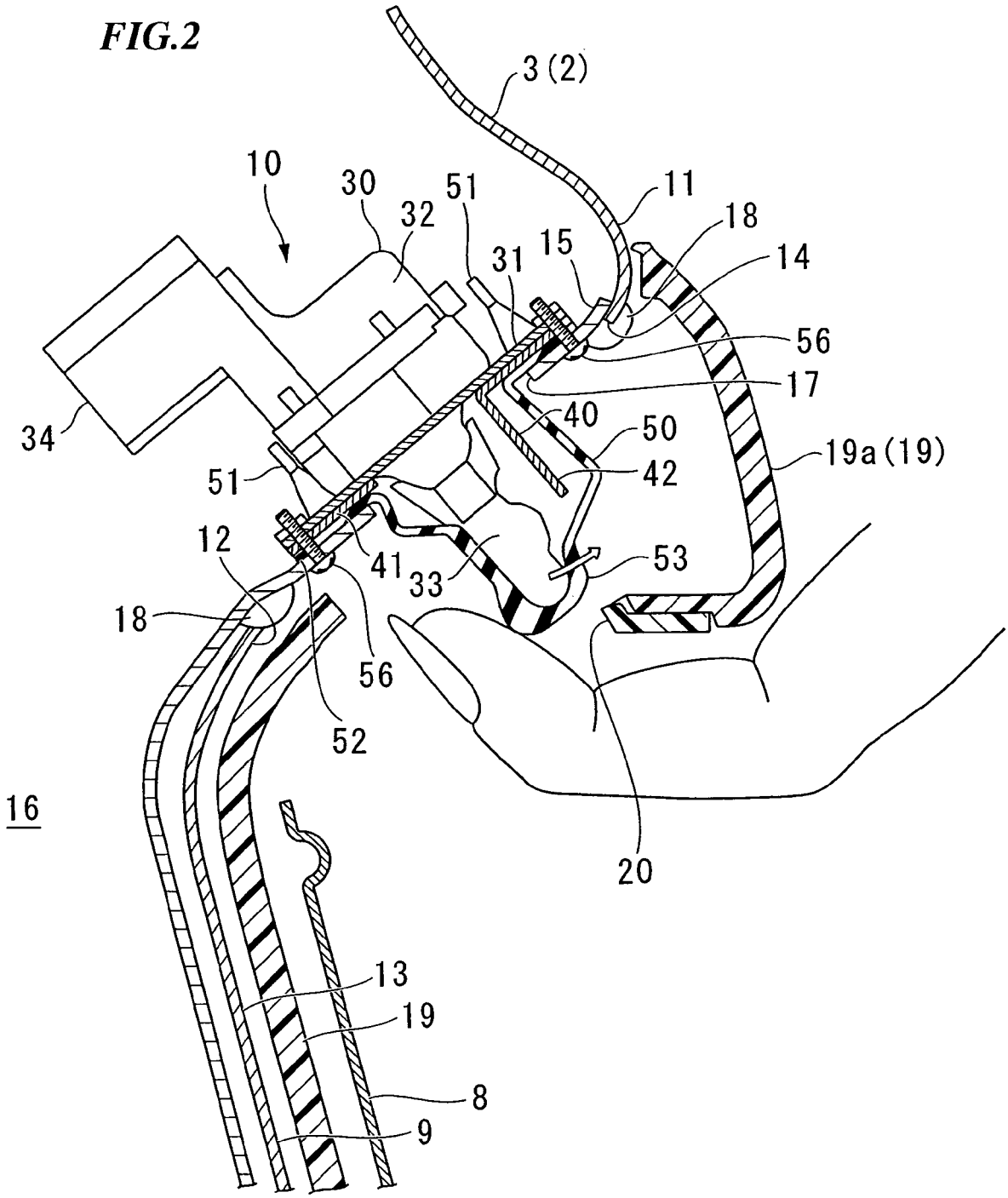
FIG. 2 is a sectional view along line A—A in FIG. 1.

FIG. 2 is a sectional view along line A—A in FIG. 1. As shown in FIG. 2, the rear wall 3 of the trunk lid 2 has (i) a portion extending downward toward the upper side of the attachment portion 9 for the license plate 8, (ii) a bent portion 11 which is bent forward (i.e., toward the right side in FIG. 2), (ii) a flat attachment portion 12 where the opening switch 10 is mounted, and (iv) an attachment face 13 for the license plate 8. Between the attachment portion 12 and the attachment face 13, a bent portion which is slightly bent backward (i.e., toward the left side in FIG. 2) is provided.

The attachment portion 12 has an attachment opening 14 to which a base plate 15, which is thicker than the rear wall 3, is attached from the inside of a trunk interior 16. The base plate 15 has an attachment hole 17 where the opening switch 10 is mounted at the inside of the trunk interior 16 by using screws 56 which are screwed in from the outside of the trunk interior 16.

To a peripheral edge of the attachment hole 17 of the base plate 15, a sealer 18 is applied so as to seal the gap between the rear wall 3 of the trunk lid 2 and the base plate 15.

A garnish 19 is provided from the bent portion 11 to the attachment portion 9 for the license plate 8. An upper portion 19*a* of the garnish 19, close to the bent portion 11 of the rear wall 3, has an approximately L-shaped section whose lower side faces the upper side of the attachment portion 9 (see FIG. 1). The garnish 19 is provided so as to cover the opening switch 10 and the attachment hole 17 of the base plate 15, and has an opening 20 in which a finger of an operator (who operates the switch) can be inserted so as to access the back side of a lower end of the opening switch 10. That is, in the opening 20, the vertical position of the lower end of the opening switch 10 approximately coincides with the lower edge of the upper portion 19*a* of the garnish 19, and the opening switch 10 is positioned behind an edge of the opening 20 in the horizontal direction (see FIG. 2).

Figure 3:
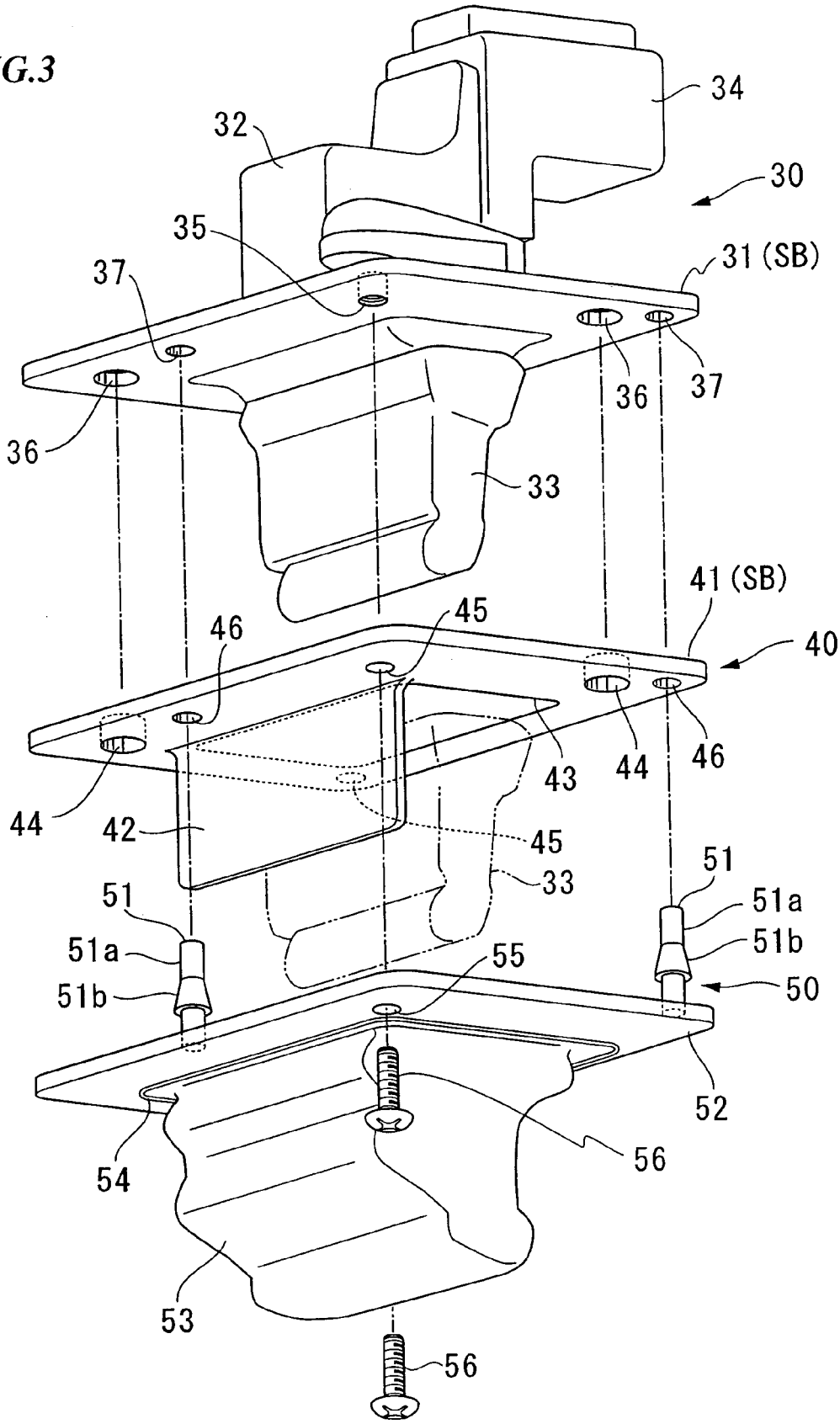
FIG. 3 is a perspective exploded view showing the opening switch in the embodiment.

FIG. 3 is a perspective exploded view showing the opening switch 10. As shown in FIGS. 2 and 3, the opening switch 10 consists of a switch assembly 30, a bracket 40, and a boot 50 (i.e., a cover member).

The switch assembly 30 has a base body 31 (i.e., the first substrate) made of metal, and a main switch body 32 is attached to one of the faces of the base body 31, and a lever portion 33 is attached to the other face. In an end portion of the main switch body 32, a socket 34 having an L-shaped portion is formed, to which a terminal of a harness (not shown) which is wired inside the trunk lid 2 is connected.

The base body 31 is a rectangular plate member in which threaded holes 35 are formed at two corners which are diagonally positioned. At the other two corners which are also diagonally positioned, holes 36 are provided, which are used for fastening the bracket 40 to the base body 31 by cramping (as explained later). In the vicinity of each hole 36, a fitting hole 37 is provided, into which a fitting portion 51 of the boot 50 is inserted and fixed. As shown in FIG. 2, the portion where each threaded hole 35 is formed is subjected to a burring process in advance, so as to secure a required thread length.

The lever portion 33 protrudes from the base body 31, and the arrow in FIG. 2 indicates the operational direction of the lever portion 33 for opening the trunk lid, that is, the lever portion 33 is supported in an inclinable form. When the operator inclines the lever portion 33 upward by using a finger, the latch state between the locking device 5 and the striker 7 is released via the main switch body 32. In comparison with general button switches, the lever portion 33 has a larger width (see FIG. 3). Therefore, even when the position pressed by the finger of the operator is shifted from the center or appropriate position in the width of the vehicle, the operation for releasing the latch can be smoothly performed.

In addition, when the lever portion 33 is inclined for a relatively long period of time (i.e., the inclined state is maintained for a long period of time), the trunk lid 2 can be opened by a manual operation, and when the lever portion 33 is inclined for a relatively short period of time (i.e., the inclined state is released after a short period of time), the trunk lid 2 is automatically opened using driving power of a motor (not shown).

The bracket 40 has a base portion 41 (i.e., the second substrate) and a flange portion 42 formed by cutting three sides of a part of the base portion 41 and then setting this part be substantially perpendicular to the base portion 41 (i.e., righting this part). Accordingly, on the base portion 41 which functions as a base for the flange portion 42, a through hole 43 is provided, into which the lever portion 33 protruding from the base body 31 of the switch assembly 30 is inserted.

The base portion 41 is a rectangular plate made of metal, and is put on the base body 31 of the switch assembly 30. When the base portion 41 and the base body 31 are put together, the protruding flange portion 42 is positioned slightly away from the lever portion 33 and is positioned on the side toward which the lever portion 33 is inclined. The base body 31 of the switch assembly 30 and the base portion 41 of the bracket 40 constitute a switch base SB.

In the base portion 41, (i) pipe-shaped cramp portions 44 are provided at positions corresponding to the above-described holes 36 of the base body 31, (ii) holes 45 are provided at positions corresponding to the above-described threaded holes 35 of the base body 31, and (iii) fitting holes 46 are formed, into which the fitting portions 51 of the boot 50 are inserted.

The boot 50 is a member made of an elastic rubber and consists of a base 52 and a cover portion 53 provided on the base 52. The base 52 is put on the base portion 41 of the bracket 40. Therefore, one of the faces of the base 52 is put on the base portion 41 of the bracket 40, and the other face closely contacts the peripheral edge of the attachment hole 17 of the base plate 15 so as to seal the contact portion and prevent water from entering from the outside. In order to improve the performance of the above sealing around the attachment hole 17, a protrusion 54 is formed on the base 52.

On the back face of the base 52, the above-described fitting portions 51 are provided, which are respectively inserted into fitting holes 46 and 37 so that the fitting portions 51 are fixed and the boot 50 is fastened to the switch assembly 30 and the bracket 40. The fitting portions 51 have top straight portions 51*a* so as to make it easy to insert the fitting portions 51 into the fitting holes 46 and 37. At the base side of each top straight portion 51*a*, a fitting body 51*b* is provided, which has a form of a truncated circular cone and has a diameter larger than that of the fitting holes 46 and 37. This fitting body 51*b* is fit through the fitting holes 46 and 37 by pulling the top straight portion 51*a*.

In the base 52, screw holes 55 are provided at positions corresponding to the threaded holes 35 of the base body 31 of the switch assembly 30 and also to the holes 45 of the base portion 41 of the bracket 40 Therefore, screws 56, inserted through the base plate 15, are further inserted into the screw holes 55 and are screwed into and engaged with the threaded holes 35 of the base body 31 of the switch assembly 30, thereby fastening the opening switch 10 to the base plate 15, that is, to the trunk lid 2.

After the switch assembly 30 and the bracket 40 are combined with the boot 50, the cover portion 53 covers a combined body consisting of the lever portion 33 and the flange 42 and is smoothly connected to the base 52. The cover portion has a watertight structure so as not to expose the lever portion 33 or the flange 42 to the outside. Owing to the rubber boot 50, the cover portion 53 is also flexible. Therefore, when the lever portion 33 is operated (i.e., inclined), the cover portion 53 can easily follow the operation.

Accordingly, when the opening switch 10 is attached to the trunk lid 2, the cramp portions 44 of the bracket 40 are inserted into the holes 36 of the switch assembly and are fixed by cramping, thereby combining the base body 31 of the switch assembly 30 and the base portion 41 of the bracket 40. This combination corresponds to the switch base SB, and the fitting portions 51 of the boot 50 are fit into the fitting holes 46 and 37 of the switch base SB, thereby mounting the boot 50, which is then fastened to the base plate 15 by the screws 56.

When operating the opening switch 10 attached as described above, a finger of the operator is inserted into the opening 20 and then drawn toward the operator side. That is, the lever portion 33, more exactly, the lever portion 33 covered with the cover portion 53 of the boot 50, is caught by the inserted finger without searching for the position of the lever portion 33, and the trunk lid 2 can be opened. As described above, if the lever portion 33 is inclined for a relatively long period of time, the trunk lid 2 can be manually opened, while if the lever portion 33 is inclined for a relatively short period of time, the trunk lid 2 can be automatically opened by driving force of a motor (not shown).

In this opening operation, even when excessive force is applied to the lever portion 33, the flange portion 42 of the bracket 40 can suppress an over stroke of the lever portion 33, thereby preventing damage to the lever portion 33. In addition, the operator can incline the lever portion 33 without controlling the operation force of the finger until the lever 33 hits the flange portion 42 of the bracket 40; thus, the operation is easily performed. That is, the operator can open the trunk lid 2 by only inserting a finger into the opening 20 and drawing the finger to the operator side without minding the operation force; thus, it is possible to remarkably improve operational performance or operability.

In addition, the lever portion 33 of the switch assembly 30 is covered with the cover portion 53 of the boot 50, together with the flange portion 42 of the bracket 40, thereby securing dust-proofing capability. That is, the lever portion 33 and the flange portion 42 protrude from the outer surface of the vehicle body while being covered with the cover portion 53 of the boot 50; thus, this structure is preferable as an outer switch which requires reliable dust-proofing capability.

The base 52 of the boot 50 is provided between the base plate 15 and the switch base SB; thus, the main switch body 32 of the switch assembly 30, and the like, can be protected from water or dust, thereby improving durability of the opening switch 10.

According to the above embodiment, the base body 31 of the switch assembly 30 and the base portion 41 of the bracket 40, which are both plate members, are put together so as to form a switch base SB. Therefore, the implemented thickness can be small and the occupied area can also be small, thereby miniaturizing the total size of the opening switch.

The structure having the main switch body 32 and the lever portion 33 on the base body 31 belongs to a known lever switch. The main portion of the opening switch 10 can be implemented by only fastening the base portion 41 of the bracket 40 to this lever switch by cramping. Therefore, the opening switch 10 can be easily manufactured through a minimized number of assembling processes with a minimum number of parts. Additionally, the lever portion 33 can be immediately found when a finger is inserted, without searching for the position of the lever portion 33; thus, the switch operation is more easily performed in comparison with button switches.

Furthermore, the flange portion 42 of the bracket 40 is formed by cutting three sides of a portion of the base portion 41 and setting upright this portion, thereby simultaneously forming the flange portion 42 and the through hole 43 for the lever portion 33 of the switch assembly 30. Therefore, the base portion 41 of the bracket 40 can have a simple and light structure, thereby reducing the total weight of the opening switch 10.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

For example, the opening and closing body is not limited to a trunk lid, and the opening switch according to the present invention may be applied to a side door or a hood of a vehicle.

What is claimed is:

1. An opening switch for an opening and closing body, the opening switch comprising:

a switch base having a first substrate and a second substrate which are put together in a manner such that inner faces of the first and second substrates face each other and outer faces of the first and second substrates are outer faces of the switch base;

a main switch body provided on the outer face of the first substrate;

a lever portion which is provided on the inner face of the first substrate and passes the second substrate through a through hole formed in the second substrate;

a flange portion for preventing an over stroke of the lever portion, wherein the flange portion protrudes from the outer face of the second substrate and is positioned away from the lever portion and on a side toward which the lever portion is inclined in an operation for the opening and closing body; and a flexible cover member for covering a combined body consisting of the lever portion and the flange portion.

2. The opening switch as claimed in claim 1, wherein:

the first substrate has a threaded hole for fastening the opening switch to the opening and closing body; and the second substrate is fastened to the first substrate by cramping.

3. The opening switch as claimed in claim 1, wherein the flange portion is formed by cutting a portion of the second substrate while leaving a side of the portion, and righting this portion.

4. The opening switch as claimed in claim 2, wherein the flange portion is formed by cutting a portion of the second substrate while leaving a side of the portion, and righting this portion.

* * * * *